United States Patent [19]

McFarland

[11] Patent Number: 5,048,689

[45] Date of Patent: Sep. 17, 1991

[54] CORRUGATED PAPERBOARD CORNER POST

[75] Inventor: William W. McFarland, Cordova, Tenn.

[73] Assignee: International Paper Company, Purchase, N.Y.

[21] Appl. No.: 597,232

[22] Filed: Oct. 15, 1990

[51] Int. Cl.[5] ..... B65D 81/02

[52] U.S. Cl. ..... 206/586; 206/453; 229/DIG. 1; 220/448

[58] Field of Search ..... 206/320, 326, 453, 586; 220/448; 229/DIG. 1

[56] References Cited

U.S. PATENT DOCUMENTS

| | | | |
|---|---|---|---|
| 1,852,832 | 4/1932 | Beaman | 206/586 |
| 2,068,771 | 1/1937 | Sherman . | |
| 2,160,221 | 5/1939 | Masters . | |
| 2,476,197 | 7/1949 | Kincaid . | |
| 2,896,833 | 7/1959 | Markman | 206/453 |
| 2,950,038 | 8/1960 | Rupp . | |
| 3,146,932 | 9/1964 | Mayer | 206/586 |
| 3,220,683 | 11/1965 | Doll . | |
| 3,337,111 | 8/1967 | Petriekis . | |
| 3,655,112 | 4/1972 | Jeffers | 206/586 |
| 3,708,101 | 1/1973 | McDanield | 206/586 |
| 3,780,929 | 12/1973 | Terrasi | 206/586 |
| 3,957,196 | 5/1976 | Kellerman | 206/586 |
| 3,982,682 | 9/1976 | Fremion | 206/586 |
| 4,027,817 | 6/1977 | Fremion . | |
| 4,260,071 | 4/1981 | Bamburg et al. | 229/DIG. 1 |
| 4,375,852 | 3/1983 | Johnston et al. | 206/586 |
| 4,399,915 | 8/1983 | Sorenson . | |
| 4,771,893 | 9/1988 | Liebel . | |
| 4,784,270 | 11/1988 | Layer et al. | 229/DIG. 1 |
| 4,865,201 | 9/1989 | Liebel | 206/586 |
| 4,899,888 | 2/1990 | Shawler | 206/453 |
| 4,927,023 | 5/1990 | Elzey | 206/586 |

*Primary Examiner*—David T. Fidei

*Attorney, Agent, or Firm*—Walt Thomas Zielinski

[57] ABSTRACT

A corner post construction fashioned from corrugated paperboard of single or more thickness. The corner post is made from a unitary blank of corrugated paperboard, the blank being generally rectangular and provided with three parallel slit scorelines running generally longitudinally of the blank. The scorelines define four generally rectangular panels, with the two innermost panels being of substantially the same width, but with the first and second outermost panels being of respectively greater and different widths. The slit scorelines are reverse cut, with the middle coming in from one surface of the unitary blank and the outer two slit scorelines coming in from the other surface. All three scorelines extend completely through the blank, except for the outermost or facing layers of the corrugated board. After slit scoring, the two outermost panels are glued to their respective next adjacent innermost panels to form the corner post in its storage or shipping condition. For use, the panels are opened and an abutment takes place between an edge of one of the two outermost panels and the other outermost panel to automatically limit rotation to 90 degrees.

4 Claims, 1 Drawing Sheet

CORRUGATED PAPERBOARD CORNER POST

BACKGROUND OF THE INVENTION

This invention relates to a corner post construction and, more particularly to a corner post fashioned from corrugated paperboard.

Corner posts fashioned from corrugated paperboard are known in this art and are useful in shipping containers. For example, when shipping a large major appliance in a paperboard carton, corner posts can be inserted in the inside corners of the carton for both vertical strength as well as protecting the corners of an article being packaged within the carton. A typical construction of a corner post is shown in Masters U.S. Pat. No. 2,160,221 and Petriekis U.S. Pat. No. 3,337,111.

Known corner post constructions fashioned from corrugated paperboard exhibit the disadvantage that they cannot be shipped in a collapsed condition. They are usually shipped in an open configuration. This results in greater storage and shipping space being required prior to their use.

SUMMARY OF THE INVENTION

According to the practice of this invention, a corner post is fashioned from corrugated paperboard and may be shipped or stored, prior to use in a container, in a condition which minimizes storage volume requirements. The corner post is fashioned from a generally rectangular unitary blank of corrugated board of one or more thicknesses. The blank is provided with three parallel slit scorelines running in the longitudinal direction of the blank. The middle slit scoreline extends completely through the blank, except for one of the facing liners of the corrugated board. The outer two slit scorelines are also cut completely through the corrugated board, except for one of the facing layers, but are reverse cut, namely, are cut on the opposite surface from the middle slit scoreline. The three slit scorelines define four generally rectangular panels, and the two innermost of these two panels are of substantially the same width. The first of the outermost panels is of a width greater than that of the two innermost panels, preferably exceeding this width by one thickness of the corrugated board. The second of the two outermost panels is of an even greater width, being substantially the width of either of the two innermost panels plus two thicknesses of the corrugated board. One surface of the first outermost panel is hinged about an integral hinge defined by one of the facing layers and is glued to a adjacent one of the two innermost panels. The second or remaining outermost panel is similarly folded and glued to its adjacent innermost panel, also about an integral hinge defined by one of the facing layers of the corrugated board. The corner post is hingeable about the integral hinge joining the two innermost panels and is folded outwardly until a longitudinal edge of the first outermost panel abuts one portion of a surface of the second outermost panel, thereby automatically forming a 90 degree angle. By slight variation of the excess in width of the first outermost panel over that of the two innermost panels, variations in this final angle can be realized.

DETAILED DESCRIPTION OF THE INVENTION

Figure 1:
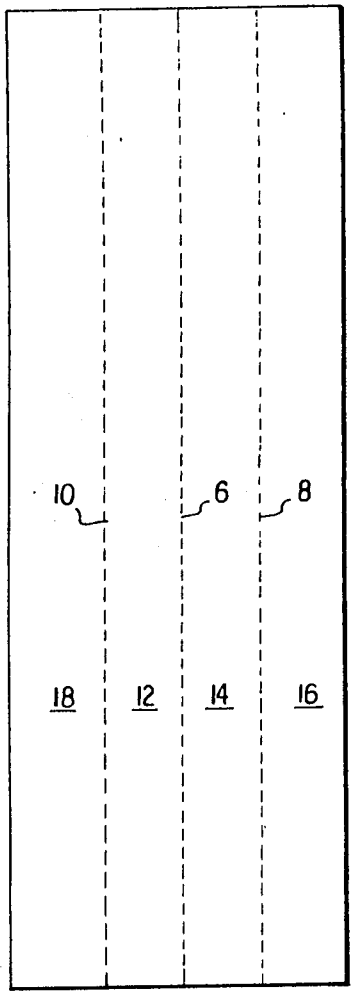
FIG. 1 is a plan view of a unitary blank of corrugated paperboard of double thickness from which the corner post of this invention is constructed.

Referring now to FIG. 1 of the drawings, the numeral 4 denotes a generally rectangular, unitary corrugated paperboard blank typically fashioned from two layers of corrugated board of otherwise conventional construction. The numerals 6, 8 and 10 denote slit scorelines extending all of the way through the blank, except for a respective outermost facing layer to which the inner corrugations are glued. The innermost slit scoreline 6 is cut from one surface of the blank, while the outer two slit scorelines 8 and 10 are cut from the opposite surface of the blank. These slit scorelines define generally rectangular panels 12, 14, 16 and 18. Panels 12 and 14 are referred to as the two innermost panels, while panels 16 and 18 are referred to as the two outermost panels. For ease in description, the first outermost panel will be designated as panel 16, while the second outermost panel will be designated as panel 18. Panels 12 and 14 are of substantially the same width, with panel 16 being wider and panel 18 be still wider. In the embodiment of the invention here described, panel 16 is wider than panels 12 or 14 but an amount equal to the thickness of the blank, while panel 18 is wider than either panel 12 or 14 by an amount equal to twice the thickness of the corrugated board blank. If the blank is of double thickness board (each thickness defined by two facing layers and a middle corrugated layer), two facing layers are glued together in surface contact.

Figure 2:
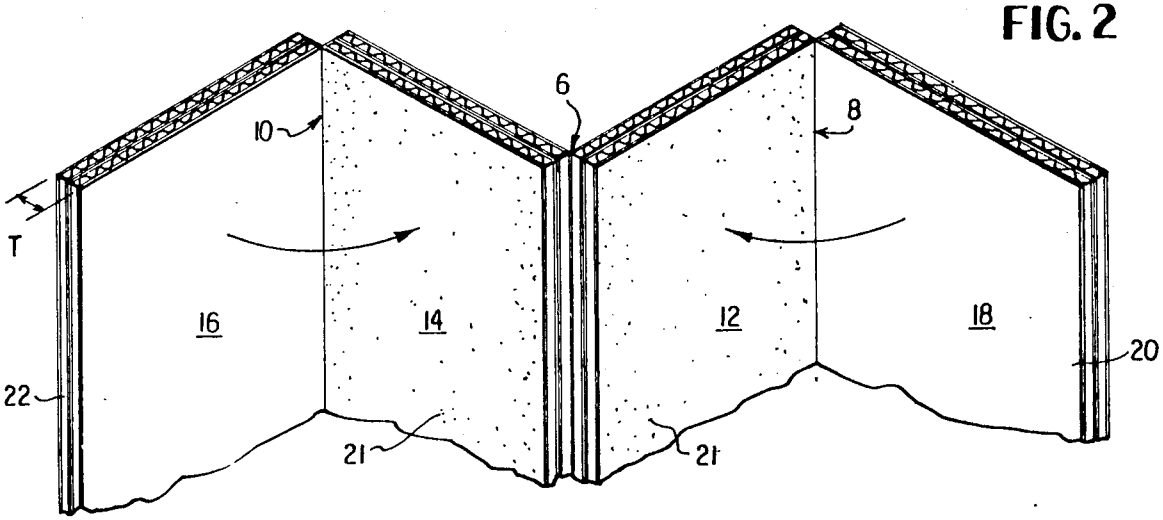
FIG. 2 is a perspective view illustrating an intermediate stage in the formation of the corner post after the slit scorelines have been made.

Referring now to FIG. 2 of the drawings, the blank 4 has been folded about respective slit scorelines 6, 8 and 10. It will be seen that the layer of the corrugated board which faces the reader at FIG. 2 includes two integral hinges associated with each of the slit scorelines 8 and 10. A third integral or living hinge is defined by the slit scoreline 6. FIG. 2 readily shows that cuts 8 and 10 extend from one facing surface layer of the corrugated board all the way through to, but short of, the opposite facing layer of the corrugated board. The same is true for slit scoreline 6, except that it extends in the opposite direction.

Panels 12 and 16 are folded together as indicated by the associated curved arrow and their facing surfaces glued together. Similarly, panels 14 and 18 are hinged together in the direction indicated by the associated curved arrow and are similarly glued together. This results in the construction shown at FIG. 3. The corner post is now in a stored or shipping condition and is ready for use.

Figure 3:
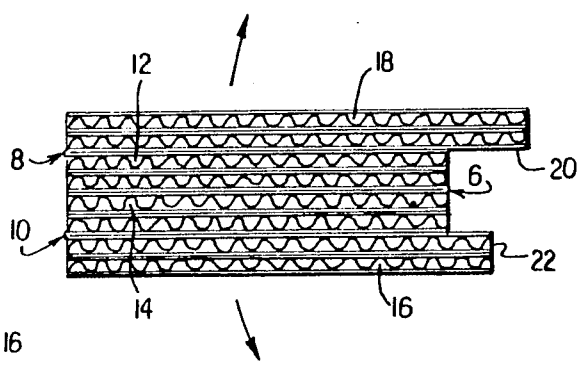
FIG. 3 is an end view illustrating the corner post of this invention in a collapsed, or storage configuration prior to use.
Figure 4:
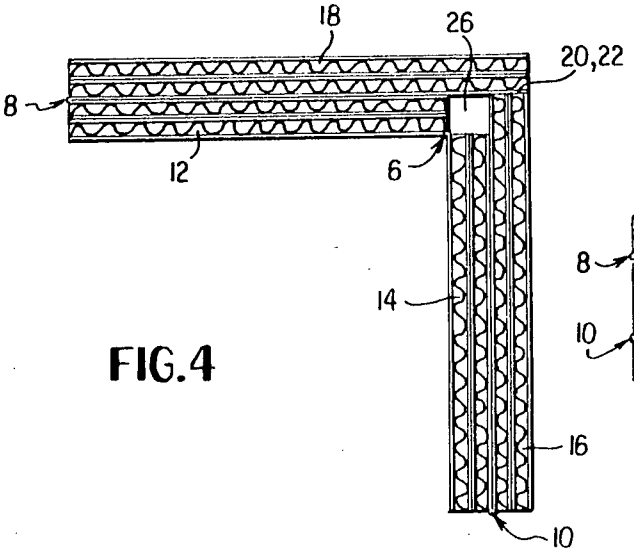
FIG. 4 is a partially perspective view showing the corner post of this invention after the element shown in FIG. 3 has been pivoted or hinged.

FIG. 4 shows the corner post in its open or operative position ready for use with a shipping container. The reader will observe that the elements shown in FIG. 3 have been pivoted about the integral hinge defined by slit scoreline 6, as shown by the curved arrows of FIG. 3. This swinging or hinging action continues until a free longitudinal edge 22 of panel 16 abuts surface portion 20 of panel 18. In the construction shown, wherein the difference in widths between panels 12 and 14 and first outermost panel 16 is one thickness of the blank 4, and wherein the width of panel 18 exceeds the width of panels 12 and 14 by two thicknesses of the corrugated board of blank 4, a 90 degree angle will be formed between the nonglued surfaces of panels 12 and 14. Similarly, an elongated and generally square in cross section recess 26 will be formed, as indicated in FIG. 4.

From a consideration of FIG. 4, it will be seen that, if the width of panel 16 were made slightly greater than shown, then the angle between the nonglued surfaces of panels 12 and 14 would be less than 90 degrees. Similarly, if the width of panel 16 were slightly less than shown at FIG. 4, then the angle between the unglued surfaces of panels 12 and 14 would be slightly greater than 90 degrees. However, since most corner post constructions are for square corner cartons have 90 degree angles, the proportions indicated at FIG. 4 are most useful.

While FIGS. 2–4 illustrate corrugated board of double thickness, it will be apparent that single thickness, or triple thickness, or even greater thicknesses of the corrugated board may be employed without departing from the invention.

I claim:

1. A foldable corner post formed from a unitary blank of corrugated paperboard having facing layers on its opposite surfaces, the post including four generally rectangular panels in series, with their longer sides parallel to each other, the arrangement of the panels defining two inner panels next to each other and two outer panels next to a respective inner panel, the inner panels being of substantially the same width, the first of the two outer panels being of greater width than said same width, the second of the two outer panels having a width greater than the width of said first outer panel, integral hinge connections between each pair of said outer and inner panels defined solely by one of said facing layers, an integral hinge connection between said two inner panels defined solely by the other of said facing layers, one of said inner and its next adjacent outer panels glued together on those surfaces of them which contain the integral hinge which joins them, the other inner and its next adjacent outer panels also glued together on those surfaces of them which contains the integral hinge which joins them.

2. The foldable corner post of claim 1 wherein said first outer panel is of a width substantially equal to said same width plus the thickness of the blank, and wherein said second outer panel is of a width substantially equal to said same width plus twice the thickness of said blank.

3. A unitary blank of corrugated paperboard for forming a corner post, said blank having facing layers on opposite surfaces, said blank being generally rectangular and having three slit scorelines, said slit scorelines being parallel to each other and running in the longer dimension of the blank, each of said slit scorelines extending through the corrugated paperboard and leaving one of said facing layers only, the two outermost of said three slit scorelines cut through one surface of said blank, the innermost of said slit scorelines cut through the other surface of the blank, the slit scorelines defining four generally rectangular panels in series along their longer sides, the two innermost panels being of the same width, the first of the outermost panels being of a width greater than said same width, the second of the outermost panels being of a width greater than of the first outermost panel.

4. The unitary corrugated paperboard blank of claim 3 wherein the width of the first outermost panel exceeds the said same width by the thickness of the blank, and wherein the width of the second outermost panel exceeds said same width by twice the thickness of the blank.

* * * * *